US011828427B1

(12) United States Patent
Shao

(10) Patent No.: US 11,828,427 B1
(45) Date of Patent: Nov. 28, 2023

(54) CURTAIN STRING LIGHT

(71) Applicant: Jianmin Shao, Taizhou (CN)

(72) Inventor: Jianmin Shao, Taizhou (CN)

(73) Assignee: Jianmin Shao, Taizhou (CN)

( * ) Notice: Subject to any disclaimer, the term of this patent is extended or adjusted under 35 U.S.C. 154(b) by 0 days.

(21) Appl. No.: 18/150,565

(22) Filed: Jan. 5, 2023

(51) Int. Cl.
*F21S 4/26* (2016.01)
*F21V 23/06* (2006.01)
*F21V 23/00* (2015.01)

(52) U.S. Cl.
CPC ..... *F21S 4/26* (2016.01); *F21V 23/001* (2013.01); *F21V 23/06* (2013.01)

(58) Field of Classification Search
CPC ..... F21S 4/20–28; F21V 23/001; F21V 23/06
See application file for complete search history.

(56) References Cited

U.S. PATENT DOCUMENTS

2007/0127242 A1* 6/2007 Allen ..... H05B 45/00 362/249.16

FOREIGN PATENT DOCUMENTS

| | | | |
|---|---|---|---|
| CN | 207455452 U | * | 6/2018 |
| CN | 213019042 U | * | 4/2021 |
| CN | 214172003 U | | 9/2021 |
| CN | 216243799 U | | 4/2022 |
| CN | 217519706 U | | 9/2022 |

* cited by examiner

*Primary Examiner* — Mariceli Santiago
(74) *Attorney, Agent, or Firm* — Nitin Kaushik

(57) ABSTRACT

The present invention discloses a colored string light, and aims to provide a curtain string light, including a string-light main line, ten string-light auxiliary' lines connected in series, and a plug combination portion. The string-light main line is connected to the string-light auxiliary lines in an electrical wire tin soldering manner via glue. The plug combination portion is arranged at an end of the string-light main line and configured to connect string-light main lines to each other. The plug combination portion includes a plug arranged at one end of the string-light main line and a socket arranged at the other end of the string-light main line. A plurality of light beads arc arranged on each of the string-light auxiliary lines.

5 Claims, 2 Drawing Sheets

CURTAIN STRING LIGHT

TECHNICAL FIELD

The present invention relates to the technical field of colored lights, and more specifically, to a curtain string light.

BACKGROUND

Curtain string lights are mounted and hung on curtains. A main line and a plurality of auxiliary lines are connected to achieve decorative lighting of a curtain. At present, auxiliary lines and a main line of a similar curtain light in the market are connected by hooks only in a welding manner. Such connection manner cannot ensure the stability of connection between the auxiliary lines and the main line. After long-time use, the auxiliary lines and the main line will be broken. Meanwhile, after sheaths of light wires are broken, electrical wires will he exposed, which may lead to a risk of electrical leakage. Therefore, a curtain string light capable of ensuring the stability of connection between the auxiliary lines and the main line is required.

SUMMARY in view of the deficiencies existing in the prior art, an objective of the present invention is to provide a curtain string light.

To achieve the above objective, the present invention provides the following technical solution: a curtain string light, including a string-light main line, string-light auxiliary' lines, and a plug combination portion, where the string-light main line is connected to the string-light auxiliary lines via glue, and the plug combination portion is arranged at an end of the string-light main line and configured to connect string-light main lines to each other.

Further, the plug combination portion includes a plug arranged at one end of the string-light main line and a socket arranged at the other end of the string-light main line, Further, the string-light main line includes a main line electrical wire and a rubber sheath for sheathing the main line electrical wire, each of the string-light auxiliary lines includes an auxiliary line electrical wire and the rubber sheath for sheathing the main line electrical wire, and the main line electrical wire is connected to the auxiliary line electrical wire in a tin soldering manner via glue.

Further, there are ten string-light auxiliary lines connected in series.

Further, a plurality of light beads are arranged on each of the string-light auxiliary lines.

Further, an outer diameter of the glue gradually increases from a left end of a joint to a center of the joint, and then gradually decreases from the center of the joint to a right end of the joint.

Further, a ratio of a width at an end of a section of the glue to a width at a center of the section of the glue in a horizontal direction is (0.2:1) to (0.8:1).

With the adoption of the above technical solution, the present invention has the following beneficial effects: 1. After the string-light auxiliary lines and the string-light main line are connected in an electrical wire soldering manner via glue; the ellipsoidal glue arranged at the joints may ensure that the main and auxiliary line electrical wires are completely wrapped together with the rubber sheaths, that is, it may ensure that the joints are insulated from the outside, and may also improve the stability of connection between the string-light auxiliary lines and the string-light main line; and the ellipsoidal glue can limit the string-light auxiliary lines, and the operation is simple and practical. 2. The curtain string light may he used for decorative lighting alone, or a plurality of curtain string lights may be connected in sequence via the plug combination portion for decorative lighting together; when the curtain string light is used alone, the plug is connected to a power supply; when the plurality of curtain string lights are connected for use, it is only required that the plug is connected to the power supply, and the socket is connected to the plug on another curtain string light; and for this connection manner. the connection is fast and the operation is simple and easy.

Figure 1:
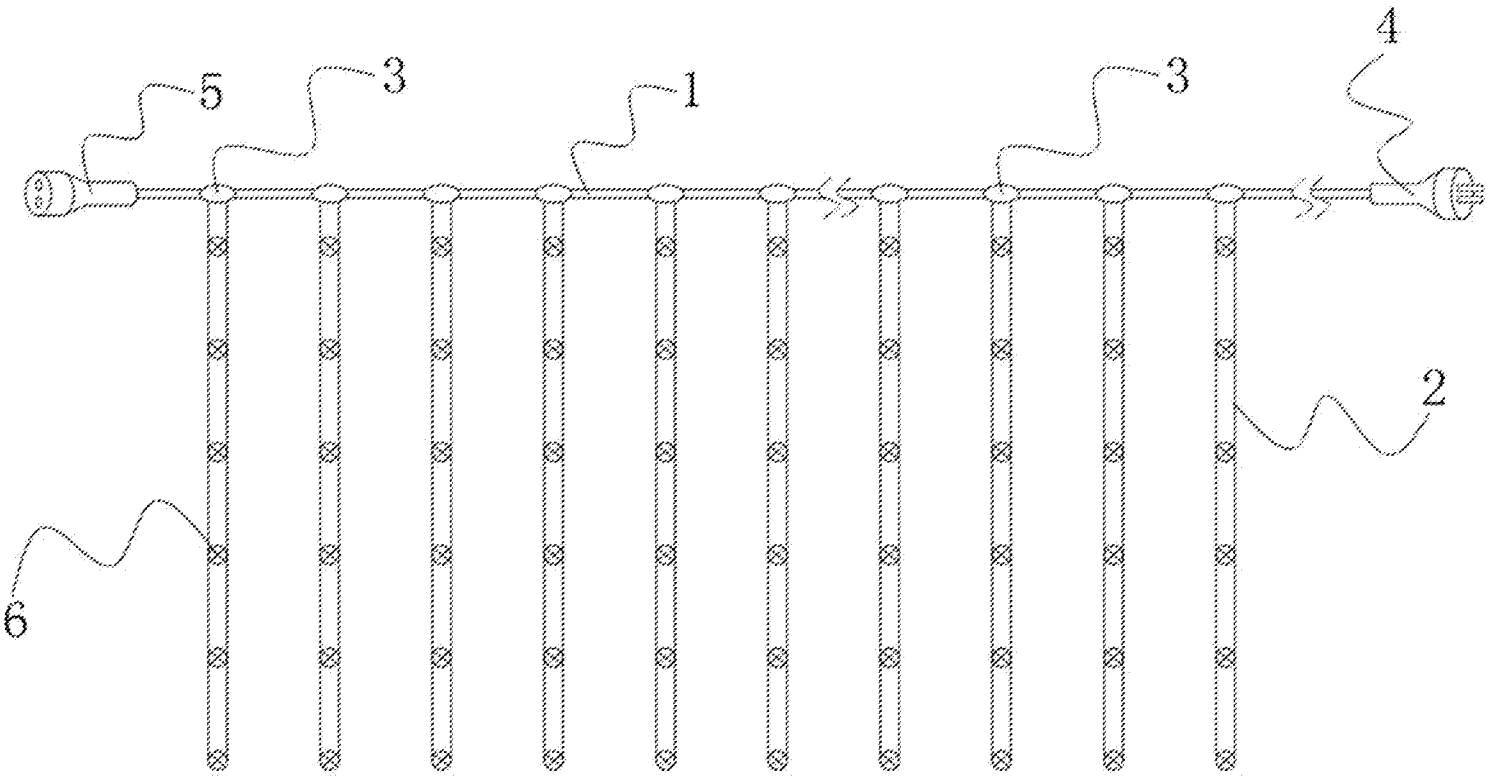
FIG. 1 is a schematic structural diagram of an embodiment of a curtain string light according to the present invention.

Reference numerals in figures: 1. ring-light main line; 2. string-light auxiliary line; 3. glue; 4. plug; 5. socket; and 6. light bead.

DETAILED DESCRIPTION OF THE EMBODIMENTS

Figure 2:
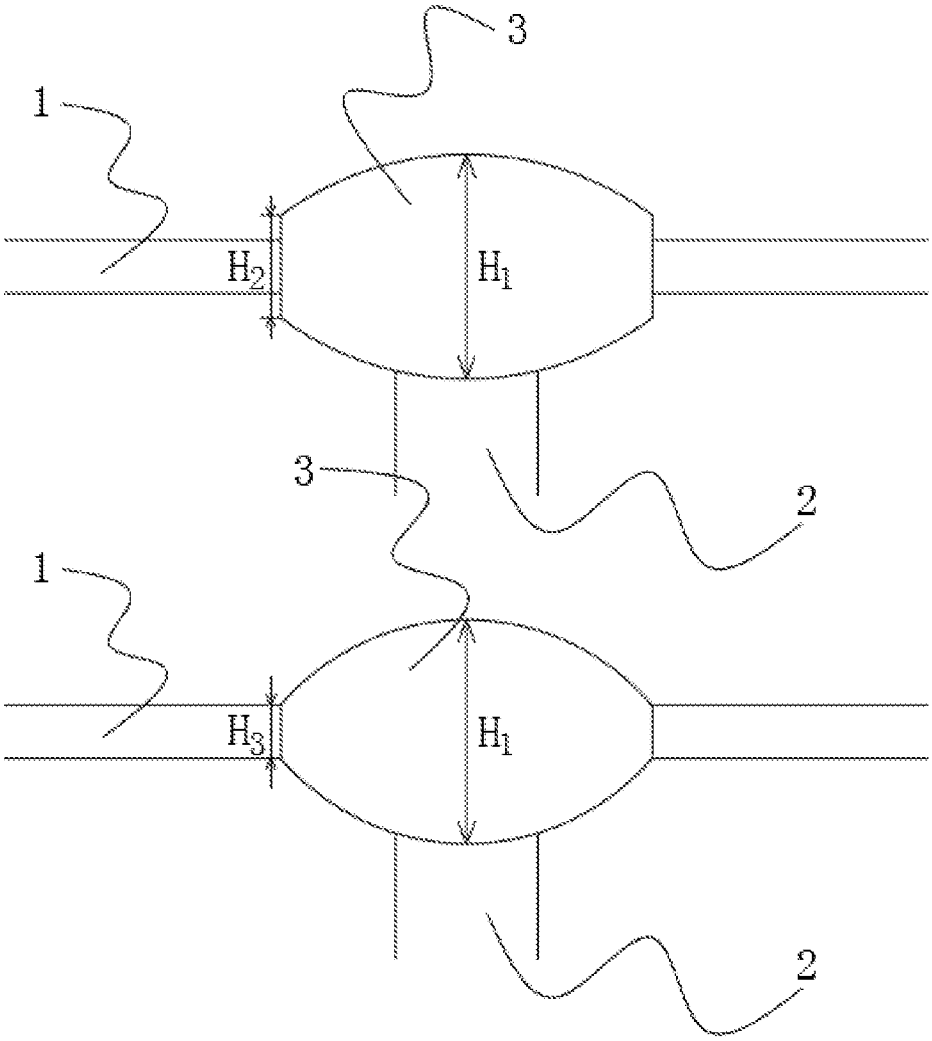
FIG. 2 is a transverse sectional view of glue.

The embodiment of a curtain string light according to the present invention is further described with reference to FIG. 1 to FIG. 2.

For ease of explanation, the relative spatial terms such as "up", "down", "left" and "right" are used in the embodiment to explain the relationship between one element or feature and another element or feature shown in the figure. It should be understood that in addition to the orientations shown in the figure, the spatial terms are intended to include different orientations of an apparatus in use or operation. For example, if the apparatus in the figure is inverted, the element described as being located "below" other element or feature will be positioned "above" other element or feature. Therefore, the exemplary term "below" may include both an upper and a lower orientation. The apparatus may be positioned in other manner (rotated 90° or positioned in other orientation), and the relative spatial description used here may be explained accordingly.

Moreover, the relational terms such as "first" and "second" are only used for distinguishing one component with the stone name from another one, and do not necessarily require or imply any such actual relationship or order between these components, A curtain string light includes a string-light main line 1, string-light auxiliary lines 2, and a plug combination portion 4. The string-light main line 1 is connected to the string-light auxiliary lines 2 via glue 3. The plug combination portion 4 is arranged at an end of the string-light main line I and configured to connect string-light main lines 1 to each other. The plug combination portion 4 includes a plug 4 arranged at one end of the string-light main line 1 and a socket 5 arranged at the other end of the string-light main line 1. The plug 4 is configured to be connected to a main line power supply or the socket 5 on another curtain string light, A plurality of curtain string lights may be connected in series via the plug 4 combination portion to together provide decorative lighting for a curtain. The string-light, main line 1 includes a main line electrical wire and a rubber sheath for sheathing the main line electrical wire. Each of the string-light auxiliary lines 2 includes an auxiliary line electrical wire and the rubber sheath for sheathing the main line electrical wire, and the main line electrical wire is connected to the auxiliary line electrical wire in a tin soldering manner via glue 3. The auxiliary line electrical wire in each of the string-light auxiliary lines 2 is connected to the main line electrical wire in the string-light main line 1, and the glue 3 is arranged at the joint and configured to implement insulation and improve the stability of the joint. The glue 3 process is simple and fast, and may effectively prevent the rubber sheaths from being broken due to multi-time bending of the string-light main line I and the string-light auxiliary lines 2. An outer diameter of the glue 3 gradually increases from a left end of the joint to a center of the joint, and then gradually decreases from the center of the joint to a right end of the joint. A ratio of a width at an end of a section of the glue to a width at a center of the section of the glue 3 in a horizontal direction is (0.2:1) to (0.8:1), In the direction of a connecting line between the socket 5 and the plug 4, the glue 3 is sectioned vertically downwards. As shown in FIG. 2, H1 is the width at the, center of the glue 3, H2 is a maximum outer diameter of two ends of the, glue 3, and H3 is a minimum outer diameter of the two ends of the glue 3 and is also the width of the string-light main line 1, where a ratio of H2 to H1 is 4:5, and a ratio of H3 to H1 is 1:5. The glue 3 arranged in this way may protect the string-light main line I and the string-light auxiliary lines 2, and generates a reverse protective action force during bending of the line, so that the service life of the curtain string light may be prolonged.

There are ten string-light, auxiliary lines 2 connected in series. A plurality of light heads 6 are arranged on each of the string-light auxiliary lines 2. One end of the string-light main line 1 is led in from the plug 4, then is connected to the first, string-light auxiliary line 2, and is connected to another string-light auxiliary line 2 after winding of the light beads 6 on the first string-light auxiliary line 2, and after the ten string-light auxiliary lines 2 are connected, winding is ended in the socket 5. The above is only the preferred embodiment of the present invention, and is not intended to limit the present invention. Common changes and substitutions made by those skilled in the art within the scope of the technical solution of the present invention should be all included in the scope of protection of the present invention.

What is claimed is:

1. A curtain string light, comprising a string-light main line, string-light auxiliary lines, and a plug combination portion, wherein the string-light main line is connected to the string-light auxiliary lines via glue, and the plug combination portion is arranged at an end of the string-light main line and configured to connect string-light main lines to each other, the string-light auxiliary lines are in series connection, an outer diameter of the glue gradually increases from a left end of a joint to a center of the joint, and then gradually decreases from the center of the joint to a right end of the joint, a ratio of a width at an end of a section of the glue to a width at a center of the section of the glue in a horizontal direction is (0.2:1) to (0.8:1).

2. The curtain string light according to claim 1, wherein the plug combination portion comprises a plug arranged at one end of the string-light main line and a socket arranged at the other end of the string-light main line.

3. The curtain string light according to claim 2, wherein the string-light main line comprises a main line electrical wire and a rubber sheath for sheathing the main line electrical wire, each of the string-light auxiliary lines comprises an auxiliary line electrical wire and the rubber sheath for sheathing the main line electrical wire, and the main line electrical wire is connected to the auxiliary line electrical wire in a tin soldering manner via glue.

4. The curtain string light according to claim 1, wherein there are ten string-light auxiliary lines connected in series.

5. The curtain string light according to claim 1, wherein a plurality of light beads are arranged on each of the string-light auxiliary lines.

* * * * *